United States Patent [19]

Greenhalgh

[11] Patent Number: 4,975,676

[45] Date of Patent: Dec. 4, 1990

[54] GLASS MEMBRANE TOUCH-CONTROLLED CIRCUIT APPARATUS FOR VOLTAGE SELECTION

[75] Inventor: Verl B. Greenhalgh, Murray, Utah

[73] Assignee: Spectra Symbol Corp., Salt Lake City, Utah

[21] Appl. No.: 435,988

[22] Filed: Nov. 13, 1989

[51] Int. Cl.[5] ..... H01C 10/10

[52] U.S. Cl. ..... 338/114; 338/99; 200/5 A

[58] Field of Search ..... 338/114, 99, 71, 69; 340/711, 712; 200/5 A, 86 R

[56] References Cited

U.S. PATENT DOCUMENTS

| | | | |
|---|---|---|---|
| 4,194,099 | 3/1980 | Mickelson | 200/5 A |
| 4,218,603 | 8/1980 | Satoh | 200/5 A |
| 4,220,815 | 2/1980 | Gibson et al. | 200/86 R |
| 4,250,495 | 2/1981 | Beckerman et al. | 340/711 |
| 4,310,839 | 1/1982 | Schwerdt | 340/712 |

*Primary Examiner*—Bruce A. Reynolds
*Assistant Examiner*—Marvin M. Lateef
*Attorney, Agent, or Firm*—Workman, Nydegger & Jensen

[57] ABSTRACT

A glass membrane touch-controlled circuit apparatus for voltage selection. The apparatus has a flexible glass membrane which is spaced by a dielectric layer adhesively joined between the upper flexible glass membrane and a lower, rigid support layer. Conductive circuitry is printed onto the surface of the upper flexible glass membrane and corresponding areas of conductive and/or resistive circuitry are printed onto the lower support layer. By application of tactile pressure to the upper flexible glass membrane, the conductive circuitry printed onto the flexible glass membrane can be moved into a point of momentary contact with the circuitry carried on the lower support layer.

42 Claims, 4 Drawing Sheets

GLASS MEMBRANE TOUCH-CONTROLLED CIRCUIT APPARATUS FOR VOLTAGE SELECTION

BACKGROUND OF THE INVENTION

1. Technical Field of the Invention

The present invention relates to touch-controlled circuit apparatus for voltage selection, and more particularly, to a glass membrane touch-controlled circuit apparatus for use in control panels requiring high-temperature, scratch-resistant characteristics.

2. The Prior State of the Art

Touch-controlled circuit devices for voltage selection are used in control panels in many types of applications in both home and industry. For example, control panels which employ such devices are used in connection with computers, elevators, video games, audiovisual equipment, stereo equipment, kitchen appliances, telephone equipment and in many other kinds of applications.

Touch-controlled circuits for voltage selection generally fall into two categories. One type of touch-controlled circuitry employs membrane-type devices which may provide for a variety of different control functions such as on-off switches and/or potentiometers which can be used in connection with single or multiple axis outputs. Examples of such touch-controlled membrane circuit devices are illustrated, for example, in U.S. Pat. Nos. 4,494,105 and No. 4,444,998, both issued to V. Dean House.

In these types of touch-controlled membrane circuit devices, a flexible membrane constructed, for example, of polyester carries a conductive surface which is spaced from another conductive surface or from a resistive surface, depending upon whether the device is to be used as an on-off contact switch or as a voltage divider. By application of tactile pressure to the flexible membrane, the conductive surface may be made to contact the other conductive or resistive film so as to provide a voltage output in the form of either an on/off voltage or a voltage which is a function of the voltage divider.

This type of touch-controlled membrane circuit device is advantageous since it provides an effective, relatively simple, low-cost device which can be used in a control panel to provide multiple functions in connection with various kinds of on-off switching controls as well as voltage dividers used in single or multiple axis selection devices such as XY controllers and the like. However, this type of device is limited with respect to some kinds of applications. For example, for some kinds of appliances or other applications it is important for the control panel to be scratch-resistant. Since touch-controlled membrane circuit devices of the mentioned type utilize flexible membrane material which is relatively soft, such as polyester, these materials are not sufficiently scratch resistant. Other kinds of appliances and applications also require that the control panel in use be capable of withstanding high temperatures, which is also a distinct limitation with respect to the mentioned type of touch-controlled membrane circuit devices. For example, control panels on a kitchen stove or oven would fall into this type of requirement.

As a result, to date flexible, touch-controlled membrane-type circuit devices have not been used with much success in control panels where such high-temperature, scratch-resistant characteristics are required. Instead, the control panels for such applications have used high-temperature, hard, inflexible materials. Because such materials are inflexible, they have been used to provide capacitive switching controls. Since this type of capacitive switching panel can only be used in connection with on-off switching functions, such control panels have typically combined functions requiring voltage selection by means of a voltage divider by using more conventional potentiometers which are operated by rotating control knobs and the like. In the alternative, in place of such control knobs, some capacitive control panels have utilized digital technology to provide for variable settings when required.

While touch-controlled capacitive switching panels do permit high-temperature materials to be used, they also suffer from certain drawbacks in terms of increased complexity with respect to the circuitry required to process the capacitive signals generated by such device. Furthermore, such capacitive switch panels also suffer from the disadvantage that they are operated based on the capacitive coupling which is sensed when the control panel is touched by the user. Accordingly, if the user has a substance on his or her hands such as lotion or some other substance or if the control panel has a substance on it, that substance may interfere with the capacitive coupling, and hence resulting in an incorrect response of the control panel under such circumstances.

BRIEF SUMMARY AND OBJECTS OF THE INVENTION

In view of the above state of the art, the present invention seeks to realize the following objects and advantages.

One object of the present invention is to provide a membrane-type circuit apparatus for voltage selection which is capable of withstanding relatively high temperatures and which is also sufficiently hard so as to be scratch resistant.

Another important object of the present invention is to provide a touch-controlled circuit apparatus having a glass membrane which is flexible enough to permit touch-controlled voltage selection.

Another object of the present invention is to provide a glass membrane touch-controlled circuit apparatus for voltage selection which can be utilized for on-off switching functions as well as voltage selection utilizing a voltage divider component.

These and other objects and advantages of the invention will become more fully apparent from the description and claims which follow, or may be learned by the practice of the invention.

Briefly summarized, the foregoing objects are achieved by an apparatus which comprises an upper flexible glass membrane which is spaced by a dielectric layer that is adhesively joined between the upper flexible glass membrane and a lower rigid support layer such as inflexible glass or stainless steel. Conductive circuitry is printed onto a surface of the upper flexible glass membrane by means of silk-screening or the like and corresponding areas of conductive and/or resistive circuitry are printed onto the lower support layer. Accordingly, by application of tactile pressure to the upper flexible glass membrane, the conductive circuitry which is printed onto the flexible glass membrane can be moved into a point of contact with the circuitry carried on the lower support layer so as to provide for the desired voltage selection functions in connection with on-off contact switches or voltage dividers. Importantly, the upper flexible glass membrane also has the characteristic of being able to withstand relatively high temperatures and of being sufficiently hard so as to be scratch resistant so as to render the membrane-type circuit apparatus useful for a large variety of applications where control panels requiring such characteristics may be particularly important or desirable.

BRIEF DESCRIPTION OF THE DRAWINGS

In order to more fully understand the manner in which the above-recited advantages and objects of the invention are obtained, a more particular description of the invention will be rendered by reference to specific embodiments thereof which are illustrated in the appended drawings. Understanding that these drawings depict only typical embodiments of the invention and are therefore not to be considered limiting of its scope, the presently preferred embodiments and the presently understood best mode of the invention will be described with additional detail through use of the accompanying drawings in which.

DETAILED DESCRIPTION OF THE PREFERRED EMBODIMENTS

In the following detailed description of the presently preferred embodiments of the invention, like parts have been designated with like numerals throughout.

Figure 1:
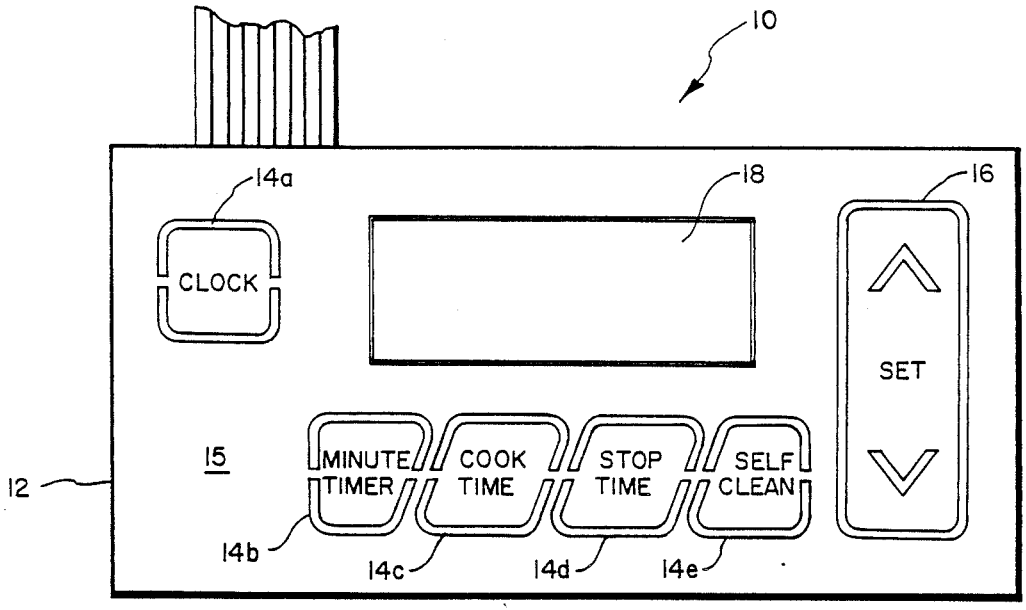
FIG. 1 is an elevated frontal view of a control panel which utilizes a glass membrane touch-controlled circuit apparatus in accordance with the present invention.

With reference first to FIG. 1, the membrane-type electrical control panel apparatus of the present invention is generally indicated at 10 in an elevated frontal view. The apparatus 10 comprises a flexible glass layer 12, as hereinafter more fully described, which is operated by application of tactile pressure upon selected areas of the outer activation surface is of the flexible glass membrane 12. The activation areas on surface 15 are designated by graphics which are screened onto the underside of the flexible glass membrane 12 so as to indicate the various areas as well as the function which is provided by each of the activation areas, as for example, areas **14*a*–14*e* and 16**.

For example, in the illustrated control panel apparatus 10, which for purposes of illustration only is intended to schematically represent a simplified control panel for use on a kitchen oven, the areas **14*a*–14*e* comprise on-off switching areas which can be selectively activated by means of tactile pressure to turn a clock on or off or to selectively activate a minute timer, the cook time, stop time or a self-cleaning feature as indicated at each of the corresponding areas 14*a*–14*e*. The area 16 of the control panel is used to activate a continuously variable membrane potentiometer by applying tactile pressure to the area 16** and by then moving the finger either vertically upward or vertically downward so as to increase or decrease a desired setting for the clock, minute timer, cook time, or stop time.

The control panel also includes an optically clear window area 18 which permits visual inspection of a digital readout used for purposes of setting the various parameters by means of the control panel, whereas the area outside of the window will typically be opaque by means of silk screening an opaque-colored graphic material to the underside of the flexible glass membrane 12, as hereinafter more fully described.

Figure 2:
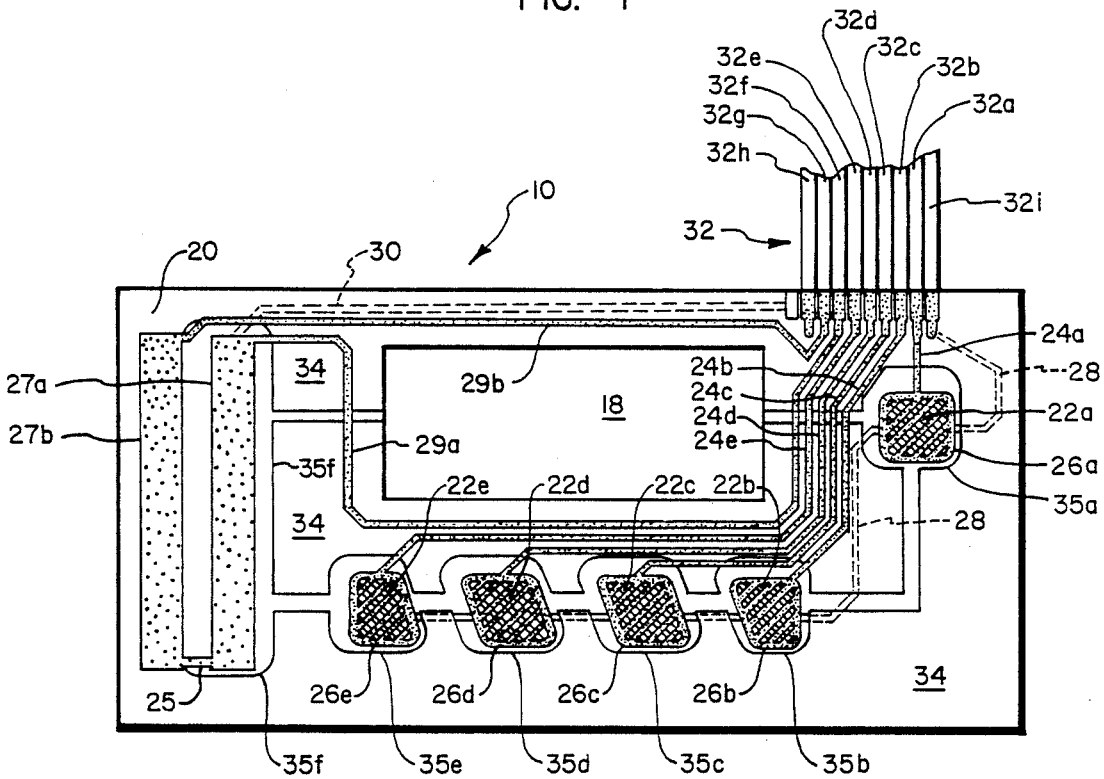
FIG. 2 is an elevated back view of the control panel of FIG. 1, more particularly illustrating the structure and components of the glass membrane touch-controlled circuit apparatus of the present invention.

FIG. 2 is an elevated back view which permits viewing of the various circuitry components and other layers of the apparatus through an optically clear support layer 20 of glass which forms the back side of the control panel. As hereinafter more fully described, while in the preferred embodiment illustrated in FIG. 2 the support layer 20 is shown and described as a layer of relatively thick, inflexible glass the support layer 20 could comprise other materials such as, for example, stainless steel.

Figure 3:
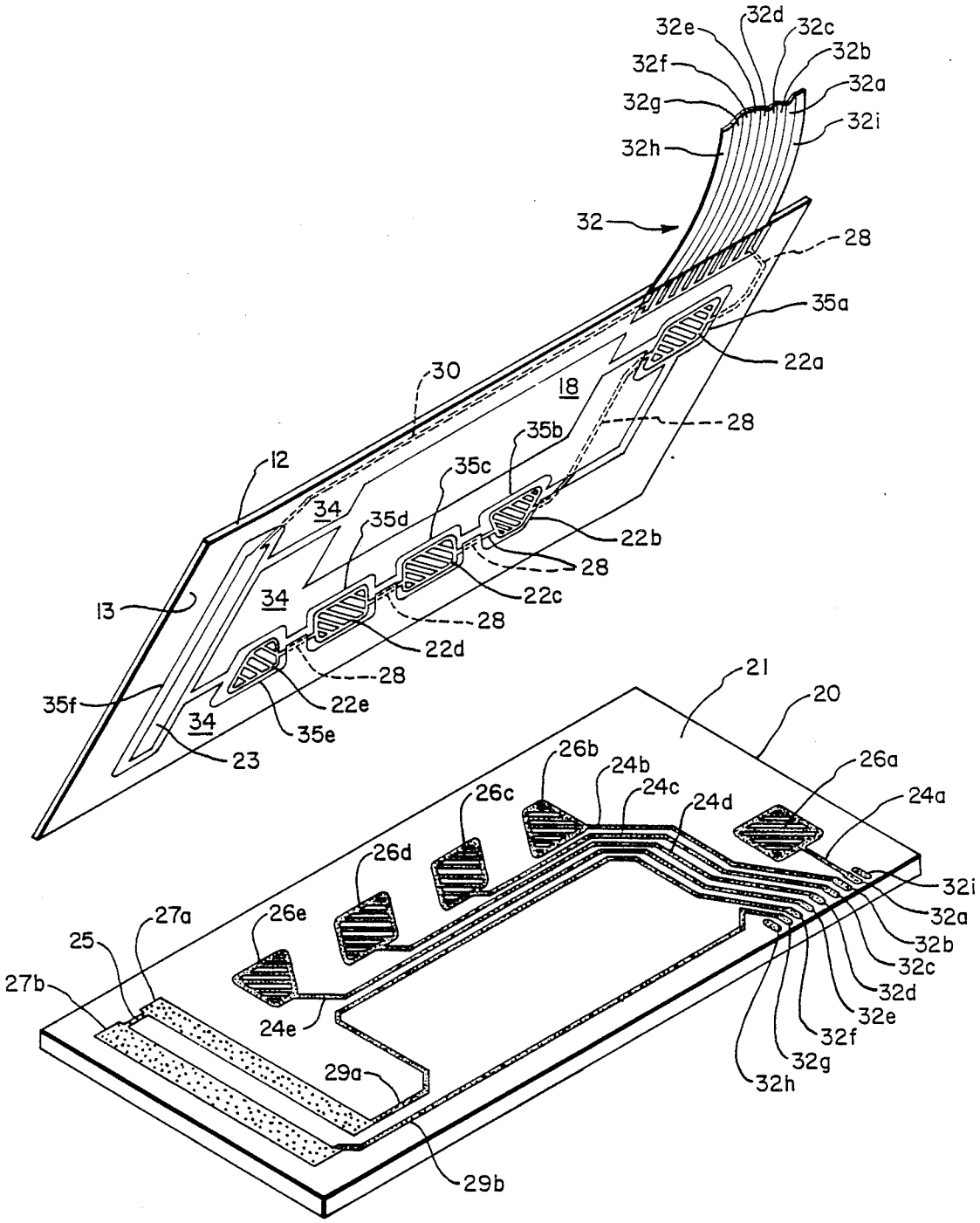
FIG. 3 is an exploded perspective view of the control panel of FIG. 1 which more particularly illustrates the upper flexible glass membrane with its associated circuitry and dielectric spacer, and the lower support layer with its associated circuitry.

The touch-controlled circuitry that is activated can be best understood from FIGS. 2 and 3 taken together. As shown best in FIG. 3, the underside 13 of the flexible glass membrane 12 is provided with various areas **22*a*–22*e* of thin-film conductive material as well as an area 23 of thin-film high resistance material. These areas of conductive and resistive circuitry 22*a*–22*e* and 23 are printed onto the underside 13 of the flexible glass membrane 12** by silk screening or other comparable processes.

Each of the circuit areas 22–23 define electrical contact areas. In the case of the circuit areas **22*a*–22*e*, the contact areas constitute one contact of an electrical on-off contact switch. The other corresponding contact is provided by the corresponding thin-film conductive circuit areas 26*a*–26*e* which are printed onto the inner, enclosed surface 21 of the inflexible glass layer 20 which forms the back part of the panel. Accordingly, the corresponding circuit areas 26*a*–26*e* and 22*a*–22*e*** are each comprised of an electrically conductive material such as a thin silver tracing, or other conductive material as for example indium tin oxide.

In a corresponding fashion, the circuit area 23 of the upper flexible membrane 12 and the circuit area **27*a* which is printed onto the lower support layer 20 likewise comprise corresponding electrical contact areas, but they serve to function as a continuously variable linear potentiometer by virtue of using a high resistance carbon formulation for the areas 27*a*–27*b*. The two high resistance thin-film carbon areas 27*a*–27*b* are electrically connected by a short conductive strip 25 to provide the appropriate resistance for the desired voltage division function based on desired output voltage levels. Accordingly, the upper area 23 is comprised of an electrically conductive material whereas the lower contact areas 27*a* and 27*b*** are comprised of an electrically resistive material.

Each of the corresponding circuit areas **22*a*–22*e* and 26*a*–26*e*, as well as circuit areas 23 and 27*a*, are held in spaced relation one from the other so that they are normally not in electrical contact by means of a dielectric material 34 which is printed onto one of the two glass surfaces 13 or 21 which oppose one another. In the illustrated embodiment the dielectric spacer material 34** is shown as being printed onto the underside 13 of glass membrane 12 in the area which surrounds the electrical contact areas. The dielectric spacer material 34 is preferably spaced far enough away from the electrically conductive contact areas 22a–22e and 27 so as to form surrounding "windows" 35a–35f which are large enough to permit adequate flexing of the glass membrane 12 within the windows 35 when tactile pressure is applied to activate the electrical contact areas. The dielectric material therefore serves to space and maintain the corresponding contact areas apart so that electrical contact is only made by application of tactile pressure upon the flexible glass membrane 12 which forms the front of the panel. By means of the tactile pressure, the corresponding electrical contact areas which are carried on the two glass layers 12 and 20 is then brought into electrical contact so as to provide the desired on-off switching function or so as to activate the voltage divider (e.g., potentiometer), as desired.

With further reference to FIGS. 2 and 3, the electrical contact areas 22a–22e which are printed onto the underside 13 of the flexible glass membrane 12 are each electrically connected one to the other by a thin conductive tracing which serves as an electrical conductor 28. Conductor 28 in turn is in electrical contact with terminal 32i which forms part of the cable generally designated at 32. The electrical contact area 23 on the underside 13 of flexible glass membrane 12 is similarly connected by a conductor 30 which is output at terminal 32h of the cable 32. In a corresponding fashion, each of the circuit areas 26a–26e which are printed onto the inner surface 21 of support layer 20 are connected by individual conductors 24a–24e to separate corresponding terminals 32a–32e as illustrated. Similarly, the two areas of high resistance carbon material 27a and 27b are electrically connected at opposite ends by conductors 29a and 29b to separate terminals 32f and 32h, respectively.

As will be appreciated from the foregoing, terminals 32f and 32g can therefore be used to impose a voltage across the opposite ends of the two resistive areas 27a and 27b by means of the conductors 29a and 29b. Voltage selection at any point along the linear potentiometer can be selected by application of tactile pressure at any point within the area 16 (see FIG. 1) of the flexible glass layer 12 which serves as the front of the control panel, thereby bringing the electrically conductive area 23 into electrical contact with the corresponding electrically resistive area 27a so as to the close the circuit by means of the conductor 30 running to terminal 32h. In a corresponding manner, the circuit for each of the electrical on-off contact switching areas 14a–e (see FIG. 1) is closed by bringing the corresponding circuit areas into electrical contact by application of the tactile pressure on the desired area, which then closes the circuit by means of the appropriate return conductor 24a–24e which is connected to the activated circuit area.

Figure 4A:
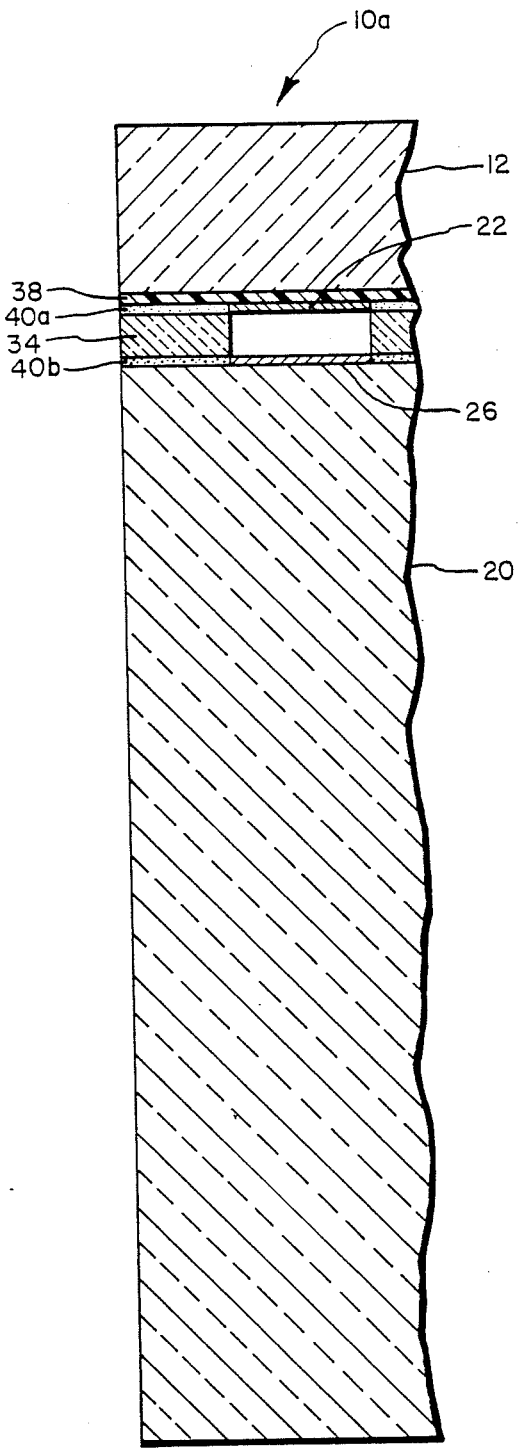
FIG. 4A is a cross-sectional view which schematically illustrates the various layers in one presently preferred embodiment of a flexible glass membrane-type circuit apparatus of the present invention.

Further understanding of the structure of the apparatus of the present invention can be derived from reference to FIG. 4A, which is a cross-sectional view schematically illustrating the way in which the various layers of the control panel are structured relative to one another. The various layers which are illustrated in FIG. 4A have been greatly enlarged to assist in more easily understanding the invention.

In one presently preferred embodiment 10a, the flexible glass layer 12 is comprised of a borasilicate material which is typically between 5 to 24 mils thick and which is designed to withstand contiuous temperatures of up to 150° C. without causing deformation of the flexible glass layer 12. Layer 12 is also designed to withstand temperatures of up to approximately 300° C. for up to five seconds without causing such deformation, and also preferably has a minimum Knopp hardness of approximately 650,000 psi. These characteristics render the flexible glass layer 12 sufficiently durable for high-temperature applications such as use of the control panel for an oven or the like, and also sufficiently hard to render the control panel scratch resistant. However, flexible glass layer 12 must also have the characteristic that it also is sufficiently elastic to permit the glass layer to yield when tactile pressure is exerted at a desired point of electrical contact, and that it also sufficiently elastic so that the glass layer will return to a point of non-electrical contact relative to the underlying support layer 20 when the tactile pressure is removed from the flexible glass membrane layer 12.

The inner, enclosed surface or underside of flexible glass layer 12 as illustrated in the embodiment 10a of FIG. 4A carries a very thin layer 38 of graphic printing which is silk screened onto the underside of layer 12. The graphics indicate the various activation areas and their associated functions, as illustrated and previously described in FIG. 1 in reference to the areas 14a–14e and 16. As previously described, since the flexible glass membrane 12 is optically clear, the graphic printing 38 can be visually perceived through the membrane layer 12. Preferably, the graphic printing is opaque in color so that the other layers and underlying circuitry components are not visible from the front of the panel, except for the area 18 (see FIG. 1) which is left clear so as to permit reading of a digital display.

The top or first electrical circuit areas 22 are also printed onto the underside of the flexible glass membrane layer 12 over the layer 38 of graphic printing. The layer 38 of graphic printing is typically approximately ½ mil thick, as is the top or first circuit 22.

The next layer that is screened onto the underside of the flexible glass membrane 12 is the layer 34 of dielectric material which is adhesively joined as indicated by the adhesive layer 40a to the underside of the glass membrane 12. The dielectric and adhesive layers 34 and 40a are typically between 1 to 3 mils thick overall.

The support layer 20 which is typically about ⅛ inch thick, in turn has the bottom or second circuit areas 26 printed onto the inner enclosed surface of the support layer 20 by such means as silk screening, as in the case of the upper circuit areas 22. The upper flexible membrane 12 is then adhesively joined to the lower support layer 20 by a thin layer 40b of adhesive material to complete the apparatus 10a. Thus, as will be appreciated from FIG. 4A, when tactile pressure is exerted on the flexible glass membrane 12 at the area defined by the electrical contact circuit areas 22 and 26, which are spaced one from the other by means of the dielectric layer 34 and adhesive layers 40 so as to not be in electrical contact, the flexible glass membrane 12 can be flexed to bring the upper circuit area 22 into momentary electrical contact with the lower circuit area 26 in the manner previously described.

In the embodiment which is generally designated at reference numeral 10b in FIG. 4A, the only difference is that the layer 38 of graphic printing has been applied to the top or activation surface of the flexible glass membrane 12 rather than to the underside of the membrane. The rest of the structure of the various layers is identical to the embodiment of FIG. 4A. Thus, as will be appreciated, the layer 38 of graphic printing can be placed either on top of or below the flexible glass membrane layer 12 so long as it is capable of being visually perceived so as to adequately define the necessary activation areas.

Figure 4B:
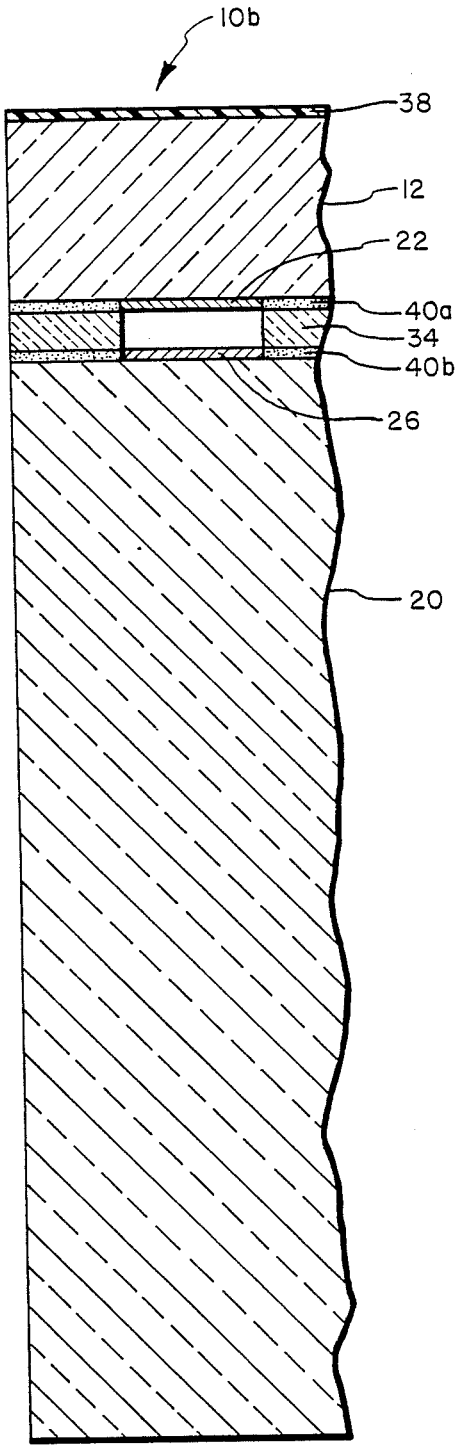
FIGS. 4B–4D are cross-sectional views which schematically illustrate alternative embodiments of the apparatus of the present invention.
Figure 4C:
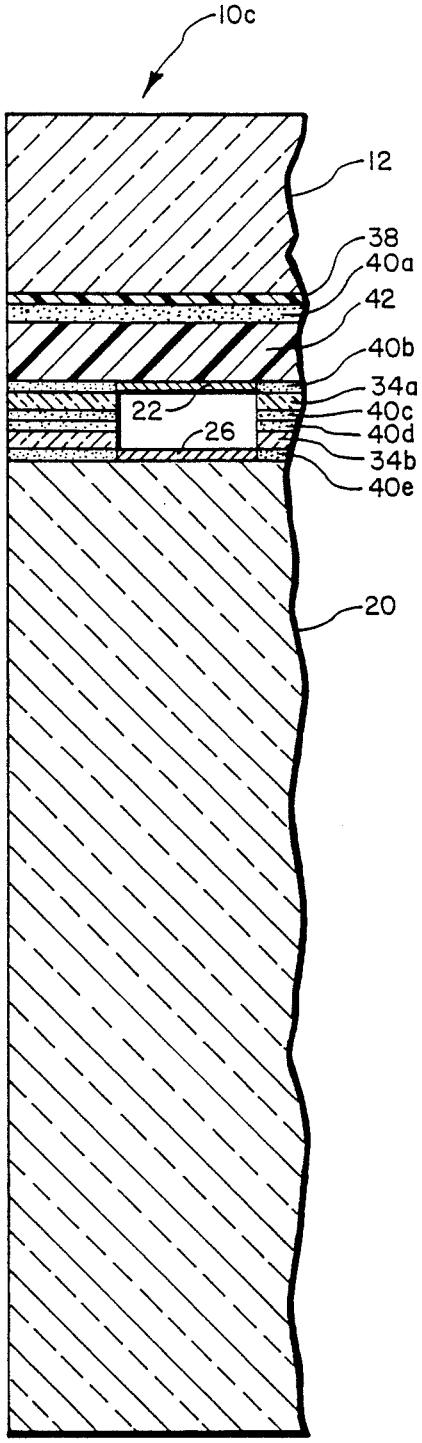

In the embodiment 10*c* which is illustrated in FIG. 4C the primary difference is the inclusion of a layer 42 of polyester material which is interposed between the underside of the flexible glass membrane 12 and the top or upper circuit contact areas 22.

The polyester layer 42 is typically on the order of 5 mils thick and is adhesively joined as indicated by the adhesive layers 40*a* and 40*b* between the dielectric layer 34*a* and the underside of the flexible glass membrane layer 12. Accordingly, polyester layer 42 with the upper circuit areas 22 constitute a conventional membrane circuit which can be utilized in conjunction with the flexible glass membrane layer 12 so as to render the overall apparatus capable of use in applications requiring high temperature, scratch resistant control panels.

As will be further appreciated from FIG. 4C, it may be necessary to slightly increase the distance by which the upper and lower circuit activation areas 22 and 26 are separated when using the additional polyester layer 42 and to accomplish this an additional layer of dielectric 34*b* may be adhesively joined to the lower support layer 20.

Figure 4D:
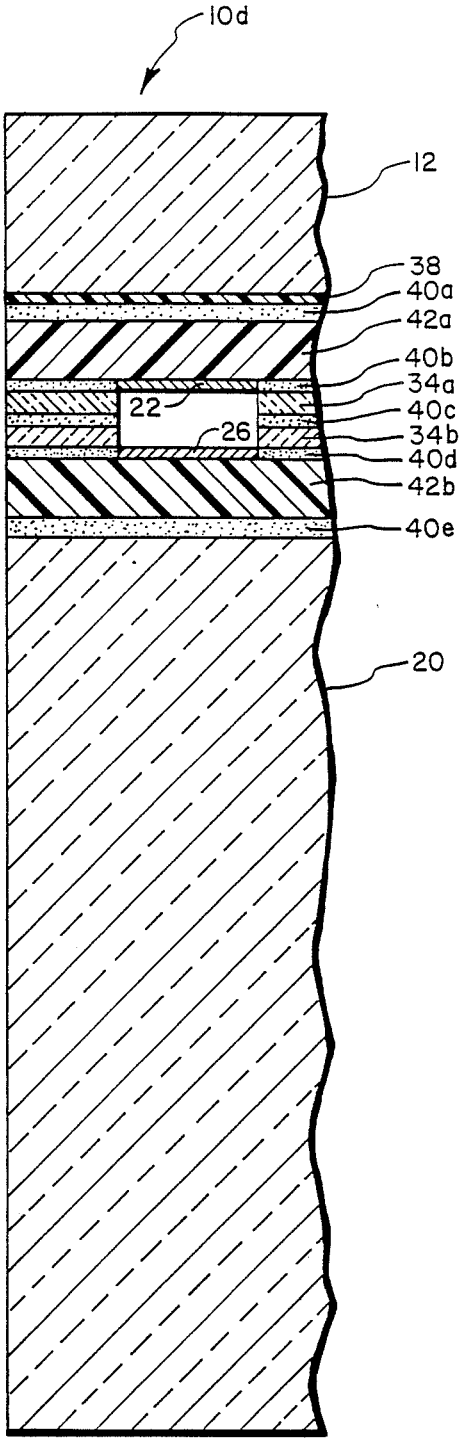

The embodiment generally indicated at 10*d* in FIG. 4D differs from the embodiment of FIG. 4C only in the addition of a second layer 42*b* of polyester material which is used to carry the lower circuit contact areas 26, again taking advantage of the use of conventional membrane circuitry which is integrated into the apparatus of the present invention and yet which still permits use of the apparatus in the aforementioned high temperature, scratch resistant type applications.

From the foregoing it will be appreciated that the present invention provides a membrane-type electrical control panel apparatus for activating electrical contact between a first and a second electrical circuit means by flexible movement of one of the circuit means in relation to the other in response to tactile pressure exerted on the membrane-type control panel apparatus. The apparatus comprises a flexible membrane means for activating electrical contact between the first and second circuit means in response to the tactile pressure which is exerted thereon, and wherein the membrane means comprises one of the circuit means and a glass layer which is sufficiently flexible to permit movement of the glass layer together with the circuit means thereon to a point of electrical contact with the other circuit means when the tactile pressure is applied to the glass layer. The glass layer is also sufficiently elastic to permit the glass layer, together with the circuit means thereon, to return to a point of non-electrical contact relative to the other circuit means when the tactile pressure is removed.

As will be appreciated from the various embodiments described above, the flexible membrane means can be configured in a variety of ways, comprising, for example, the layer 38 of graphic printing on the underside of the flexible glass membrane 12 in combination with the upper circuit areas 22 as illustrated in FIG. 4A, or may comprise simply the flexible glass membrane 12 in combination with the upper circuit areas 22 as illustrated in FIG. 4B, or may even comprise in combination the flexible glass layer 12 together with the layer 42 of polyester which carries the upper circuit areas 22 as illustrated in FIG. 4C.

As will be further appreciated from the various embodiments described, the apparatus also comprises a support layer means for holding the other circuit means stationary, and wherein the support layer means may comprise a glass or stainless steel layer 20 together with the lower circuit areas 26 printed thereon as shown in FIGS. 4A–4C, or may comprise in combination the lower support layer 20 together with a layer of polyester material 42 with the lower circuit areas 26 printed thereon.

The apparatus also comprises a spacer means which may be configured in various ways as illustrated and described in reference to FIGS. 4A–4D, comprising one or more layers of polyester material or other dielectric material.

The first and second circuit means of the apparatus may also be configured in a variety of ways, including areas which define thin-film tracings of electrically conductive material and/or areas containing thin-film tracings of high resistant material so as to form not only on-off tactile switch areas, but also electrical potentiometer activation areas, when so desired.

From the foregoing, it will be appreciated that the present invention may be embodied in a number of different specific forms without departing from its spirit or essential characteristics and accordingly, the described embodiments are to be considered in all respects only as illustrative and not restrictive. The scope of the invention is, therefore, indicated by the dependant claims rather than the foregoing description, and all changes which come within the meaning and range of equivalency of the claims are to be embraced within their scope.

What is claimed is:

1. A membrane-type electrical control panel apparatus for activating electrical contact between a first and a second electrical circuit means by flexible movement of one of said circuit means in relation to the other in response to tactile pressure exerted on said membrane-type control panel apparatus, said apparatus comprising:

a flexible membrane means for activating electrical contact between said first and second circuit means in response to tactile pressure exerted on said membrane means, said membrane means comprising one of said circuit means and a continuous topmost glass layer having sufficient flexibility to permit flexible movement of said glass layer together with said one circuit means to a point of electrical contact with the other said circuit means when said tactile pressure is applied to said glass layer, and said glass layer having sufficient elasticity to permit said glass layer together with said one circuit means to return to a point of non-electrical contact with the other said circuit means when said tactile pressure is removed from said glass layer;

support layer means for holding said other circuit means stationary; and spacer means for spacing said flexible membrane means from said support layer means so as to prevent electrical contact between said first and second circuit means until said tactile pressure is exerted.

2. An apparatus as defined in claim 1 wherein said flexible membrane means further comprises a polyester layer adhesively joined at one surface thereof to said glass layer, and wherein said one circuit means is carried by another surface of said polyester layer which is opposite to said one surface.

3. An apparatus as defined in claim 2 wherein said support layer means comprises a polyester layer adhesively joined at one surface thereof to an inflexible glass layer, and wherein said other circuit means is carried by another surface of the polyester layer which is opposite to the surface joined to said inflexible glass layer.

4. An apparatus as defined in claim 3 wherein said spacer means comprises a layer of dielectric material adhesively joined between said polyester layers of said membrane means and said support layer means.

5. An apparatus as defined in claim 4 wherein said glass layer of the flexible membrane means has a thickness of between 5 to 24 mils, wherein each said polyester layer is approximately 5 mils thick, wherein said layer of dielectric material is approximately 1 to 3 mils thick, and wherein said inflexible glass layer is approximately one eighth inch thick.

6. A apparatus as defined in claim 2 wherein said support layer means comprises an inflexible glass layer and wherein said spacer means comprises a layer of dielectric material adhesively joined between said inflexible glass layer and said polyester layer.

7. An apparatus as defined in claim 6 wherein said glass layer of the flexible membrane means has a thickness of between 5 to 24 mils, wherein each said polyester layer is approximately 5 mils thick, wherein said layer of dielectric material is approximately 1 to 3 mils thick, and wherein said inflexible glass layer is approximately one eighth inch thick.

8. An apparatus as defined in claim 1 wherein said support layer means comprises an inflexible glass layer and wherein said spacer means comprises a layer of dielectric material adhesively joined between said inflexible glass layer and said glass layer of the flexible membrane means.

9. An apparatus as defined in claim 8 wherein said glass layer of the flexible membrane means has a thickness of between 5 to 24 mils, wherein said layer of dielectric material is approximately 1 to 3 mils thick, and wherein said inflexible glass layer is approximately one eighth inch thick.

10. An apparatus as defined in claim 2 wherein said flexible membrane means further comprises a layer of graphic printing interposed between said polyester layer and said glass layer, said graphic printing defining one or more areas intended for receiving said tactile pressure to activate electrical contact between said first and second circuit means, and said glass layer being optically clear to permit visual perception of said layer of graphic printing.

11. An apparatus as defined in claim 1 wherein said flexible membrane means further comprises a layer of graphic printing placed on an upper surface of said glass layer, said graphic printing defining one or more areas intended for receiving said tactile pressure to activate electrical contact between said first and second circuit means.

12. An apparatus as defined in claim 1 wherein said flexible membrane means further comprises a layer of graphic printing interposed between said one circuit means and said glass layer, said graphic printing defining one or more areas intended for receiving said tactile pressure to activate electrical contact between said first and second circuit means, and said glass layer being optically clear to permit visual perception of said layer of graphic printing.

13. An apparatus as defined in claim 1 wherein said glass layer comprises a borasilicate material which can withstand continuous temperatures up to 150° C. without causing deformation of said glass layer, which can withstand temperatures of up to approximately 300° C. for up to five seconds without causing said deformation, and which has a minimum Knoop hardness of approximately 650,000 psi.

14. An apparatus as defined in claim 1 wherein said first and second electrical circuit means each comprise a thin-film tracing of electrically conductive material with corresponding portions thereof formed as on-off tactile switch areas.

15. An apparatus as defined in claim 1 wherein one of said first and second electrical circuit means comprises an area containing a thin-film tracing of high resistance material and wherein the other said circuit means comprises a corresponding area containing a thin-film tracing of electrically conductive material so as to form an electrical potentiometer when one area contacts the other.

16. A membrane-type electrical control panel apparatus comprising:

a thin, flexible glass layer having a continuous outer activation surface on which tactile pressure is exerted, and a continuous inner, enclosed surface;

a first thin-film circuit means for defining a first plurality of electrical contact areas which can be selectively activated by application of said tactile pressure to areas of said outer activation surface corresponding to said contact areas, said first circuit means being carried on said inner, enclosed surface of the flexible glass layer;

a support layer having an inner, enclosed surface which faces the inner, enclosed surface of said flexible glass layer;

a second thin-film circuit means for defining a second plurality of electrical contact areas, said second circuit means being carried on said inner, enclosed surface of said support layer such that each area of said second plurality of electrical contact areas is positioned for electrical contact by one of said first plurality of electrical contact areas, thereby forming a plurality of pairs of the corresponding areas defined by said first and second circuit means; and a dielectric layer interposed between the inner, enclosed surfaces of said flexible glass layer and said support layer, said dielectric layer serving to space said first and second plurality of contact areas one from the other so that electrical contact occurs only in response to said tactile pressure, and wherein said glass layer is sufficiently flexible to permit movement of said first circuit means into electrical contact with said second circuit means at any of said electrical contact areas at which said tactile pressure is applied, and said glass layer having sufficiently elasticity to permit return of said first circuit means to a spaced position of nonelectrical contact with respect to said second circuit means when said tactile pressure is removed.

17. An apparatus as defined in claim 16 further comprising a layer of graphic printing interposed between said first circuit means and the inner, enclosed surface of said flexible glass layer, said layer of graphic printing defining a plurality of tactile areas corresponding to said first plurality of electrical contact areas defined by said first circuit means, and said flexible glass layer being optically clear to permit visual perception of said tactile areas.

18. An apparatus as defined in claim 16 wherein at least some of said first and second plurality of electrical contact areas are each defined by thin-film conductive material so that each said corresponding pair of electrical contact areas of the first and second circuit means together form an on-off tactile switch.

19. An apparatus as defined in claim 18 wherein at least one of the electrical contact areas of said second circuit means is defined by a high-resistance thin-film material, so that at least one electrical contact area defines an electrical potentiometer that is touch-controlled.

20. An apparatus as defined in claim 16 wherein said glass layer comprises a borasilicate material which can withstand continuous temperatures up to 150° C. without causing deformation of said glass layer, which can withstand temperatures of up to approximately 300° C. for up to five seconds without causing said deformation, and which has a minimum Knoop hardness of approximately 650,000 psi.

21. An apparatus as defined in claim 20 wherein said glass layer has a thickness between 5 and 24 mils.

22. An apparatus as defined in claim 21 wherein said support layer comprises a layer of inflexible glass having a thickness of approximately one eighth inch.

23. An apparatus as defined in claim 21 wherein said support layer comprises a layer of stainless steel.

24. An apparatus as defined in claim 21 wherein said dielectric layer is approximately 1 to 3 mils thick.

25. An apparatus as defined in claim 16 wherein said first circuit means comprises a polyester layer adhesively joined at one surface thereof to said thin flexible glass layer at the inner enclosed surface thereof, and wherein said first plurality of electrical contact areas is deposited on another surface of said polyester layer which is opposite to said one surface.

26. An apparatus as defined in claim 25 further comprising a layer of graphic printing interposed between said first circuit means and the inner, enclosed surface of said flexible glass layer, said layer of graphic printing defining a plurality of tactile areas corresponding to said first plurality of electrical contact areas defined by said first circuit means, and said flexible glass layer being optically clear to permit visual perception of said tactile areas.

27. An apparatus as defined in claim 26 wherein said dielectric layer is adhesively joined to the same surface as said first thin-film circuit means.

28. An apparatus as defined in claim 27 wherein said second thin-film circuit means comprises a polyester layer adhesively joined at one surface thereof to said inner enclosed surfaced of said support layer, and wherein said second plurality of electrical contact areas is deposited on another surface of the second polyester layer which is opposite to the surface of the second polyester layer joined to the inner enclosed surface of the support layer.

29. An apparatus as defined in claims 27 or 28 wherein at least same of said first and second plurality of electrical contact areas are each defined by thin-film conductive material so that each said corresponding pair of electrical contact areas of the first and second circuit means together form an on-off tactile switch.

30. An apparatus as defined in claim 29 wherein at least one of the electrical contact areas of said second circuit means is defined by a high-resistance thin-film material, so that at least one electrical contact area defines an electrical potentiometer that is touch-controlled.

31. A membrane-type electrical control panel apparatus comprising:

a thin, flexible glass layer having a continuous outer activation surface on which tactile pressure is exerted, and an inner, enclosed surface;

a first thin-film circuit defining a first plurality of electrical contact areas which can be selectively activated by application of said tactile pressure to areas of said outer activation surface corresponding to said contact areas, said first plurality of electrical contact areas being carried on said inner, enclosed surface of the flexible glass layer;

a support layer having an inner, enclosed surface which faces the inner, enclosed surface of said flexible glass layer;

a second thin-film circuit defining a second plurality of electrical contact areas, said second plurality of electrical contact areas being carried on said inner, enclosed surface of said support layer such that each area of said second plurality of electrical contact areas is positioned for electrical contact by one of said first plurality of electrical contact areas, thereby forming a plurality of pairs of the corresponding areas defined by said first and second circuit means; and a dielectric layer adhesively held between the inner, enclosed surfaces of said flexible glass layer and said support layer, said dielectric layer serving to space said first and second plurality of contact areas one from the other so that electrical contact occurs only in response to said tactile pressure, and wherein said glass layer is sufficiently flexible to permit movement of said first circuit into electrical contact with said second circuit at any of said electrical contact areas at which said tactile pressure is applied, and said glass layer having sufficiently elasticity to permit return of said first circuit to a spaced position of non-electrical contact with respect to said second circuit when said tactile pressure is removed.

32. An apparatus as defined in claim 31 further comprising a layer of graphic printing interposed between said first circuit and the inner, enclosed surface of said flexible glass layer, said layer of graphic printing defining a plurality of tactile areas corresponding to said first plurality of electrical contact areas defined by said first circuit, and said flexible glass layer being optically clear to permit visual perception of said tactile areas.

33. An apparatus as defined in claim 32 wherein at least some of said first and second plurality of electrical contact areas are each defined by thin-film conductive material so that each said corresponding pair of electrical contact areas of the first and second circuits together form an on-off tactile switch.

34. An apparatus as defined in claim 33 wherein at least one of the electrical contact areas of said second circuit is defined by a high-resistance thin-film material, so that at least one electrical contact area defines an electrical potentiometer that is touch-controlled.

35. A membrane-type electrical control panel apparatus comprising:

a thin, flexible glass layer having a continuous outer activation surface on which tactile pressure is exerted, and a continuous inner, enclosed surface;

a first polyester layer adhesively joined at one surface thereof to said inner enclosed surface of the thin flexible glass layer;

a first thin-film circuit defining a first plurality of electrical contact areas which can be selectively activated by application of said tactile pressure to areas of said outer activation surface corresponding to said contact areas, said first plurality of electrical contact areas being carried on another surface of said first polyester layer that is opposite to said one surface of said polyester layer;

a support layer having an inner, enclosed surface which faces the inner, enclosed surface of said flexible glass layer;

a second thin-film circuit defining a second plurality of electrical contact areas, said second plurality of electrical contact areas being carried on said inner, enclosed surface of said support layer such that each area of said second plurality of electrical contact areas is positioned for electrical contact by one of said first plurality of electrical contact areas, thereby forming a plurality of pairs of the corresponding areas defined by said first and second circuit means; and a dielectric layer interposed between the inner, enclosed surfaces of said flexible glass layer and said support layer, said dielectric layer serving to space said first and second plurality of contact areas one from the other so that electrical contact occurs only in response to said tactile pressure, and wherein said glass layer is sufficiently flexible to permit movement of said first circuit into electrical contact with said second circuit at any of said electrical contact areas at which said tactile pressure is applied, and said glass layer having sufficiently elasticity to permit return of said first circuit to a spaced position of non-electrical contact with respect to said second circuit when said tactile pressure is removed.

36. An apparatus as defined in claim 35 further comprising a layer of graphic printing interposed between said first circuit and the inner, enclosed surface of said flexible glass layer, said layer of graphic printing defining a plurality of tactile areas corresponding to said first plurality of electrical contact areas defined by said first circuit, and said flexible glass layer being optically clear to permit visual perception of said tactile areas.

37. An apparatus as defined in claim 36 wherein at least some of said first and second plurality of electrical contact areas are each defined by thin-film conductive material so that each said corresponding pair of electrical contact areas of the first and second circuits together form an on-off tactile switch.

38. An apparatus as defined in claim 37 wherein at least one of the electrical contact areas of said second circuit is defined by a high-resistance thin-film material, so that at least one electrical contact area defines an electrical potentiometer that is touch-controlled.

39. A membrane-type electrical control panel apparatus comprising:

a thin, flexible glass layer having a continuous outer activation surface on which tactile pressure is exerted, and a continuous inner, enclosed surface;

a first polyester layer adhesively joined at one surface thereof to said inner enclosed surface of the thin flexible glass layer;

a first thin-film circuit defining a first plurality of electrical contact areas which can be selectively activated by application of said tactile pressure to areas of said outer activation surface corresponding to said contact areas, said first plurality of electrical contact areas being carried on another surface of said first polyester layer that is opposite to said one surface of said first polyester layer;

a support layer having an inner, enclosed surface which faces the inner, enclosed surface of said flexible glass layer;

a second polyester layer adhesively joined at one surface thereof to the inner enclosed surface of said support layer;

a second thin-film circuit defining a second plurality of electrical contact areas, said second plurality of electrical contact areas being carried on another surface of said second polyester layer that is opposite to said one surface of the second polyester layer such that each area of said second plurality of electrical contact areas is positioned for electrical contact by one of said first plurality of electrical contact areas, thereby forming a plurality of pairs of the corresponding areas defined by said first and second circuits; and a dielectric layer interposed between the inner, enclosed surfaces of said flexible glass layer and said support layer, said dielectric layer serving to space said first and second plurality of contact areas one from the other so that electrical contact occurs only in response to said tactile pressure, and wherein said glass layer is sufficiently flexible to permit movement of said first circuit into electrical contact with said second circuit at any of said electrical contact areas at which said tactile pressure is applied, and said glass layer having sufficiently elasticity to permit return of said first circuit to a spaced position of non-electrical contact with respect to said second circuit when said tactile pressure is removed.

40. An apparatus as defined in claim 39 further comprising a layer of graphic printing interposed between said first circuit and the inner, enclosed surface of said flexible glass layer, said layer of graphic printing defining a plurality of tactile areas corresponding to said first plurality of electrical contact areas defined by said first circuit, and said flexible glass layer being optically clear to permit visual perception of said tactile areas.

41. An apparatus as defined in claim 40 wherein at least some of said first and second plurality of electrical contact areas are each defined by thin-film conductive material so that each said corresponding pair of electrical contact areas of the first and second circuits together form an on-off tactile switch.

42. An apparatus as defined in claim 41 wherein at least one of the electrical contact areas of said second circuit is defined by a high-resistance thin-film material, so that at least one electrical contact area defines an electrical potentiometer that is touch-controlled.

* * * * *

UNITED STATES PATENT AND TRADEMARK OFFICE

CERTIFICATE OF CORRECTION

PATENT NO. : 4,975,676

DATED : December 4, 1990

INVENTOR(S) : VERL B. GREENHALGH

It is certified that error appears in the above-identified patent and that said Letters Patent is hereby corrected as shown below:

Column 2, line 25, "resulting" should be --result--
Column 3, line 53, delete "is"
Column 8, line 31, "dependant" should be --dependent--
Column 9, line 21, "A apparatus" should be --An apparatus--
Column 10, line 59, "sufficiently elasticity" should be --sufficient elasticity--
Column 12, lines 41-42, "sufficiently elasticity" should be --sufficient elasticity--
Column 13, lines 35-36, "sufficiently elasticity" should be --sufficient elasticity--
Column 14, lines 39-40, "sufficiently elasticity" should be --sufficient elasticity--

Signed and Sealed this

Twentieth Day of October, 1992

*Attest:*

DOUGLAS B. COMER

*Attesting Officer*

*Acting Commissioner of Patents and Trademarks*